US010531533B1

(12) United States Patent
Hsu et al.

(10) Patent No.: US 10,531,533 B1
(45) Date of Patent: Jan. 7, 2020

(54) LIGHT-EMITTING DIODE LIGHTING SYSTEM WITH AUTOMATIC BLEEDER CURRENT CONTROL

(71) Applicant: IML International, Grand Cayman (KY)

(72) Inventors: Horng-Bin Hsu, Taipei (TW); Yi-Mei Li, New Taipei (TW)

(73) Assignee: IML International, Grand Cayman (KY)

( * ) Notice: Subject to any disclaimer, the term of this patent is extended or adjusted under 35 U.S.C. 154(b) by 0 days.

(21) Appl. No.: 16/558,326

(22) Filed: Sep. 3, 2019

Related U.S. Application Data

(60) Provisional application No. 62/731,969, filed on Sep. 16, 2018.

(51) Int. Cl.
*H05B 37/00* (2006.01)
*H05B 33/08* (2006.01)
*H05B 37/02* (2006.01)

(52) U.S. Cl.
CPC ..... *H05B 33/0851* (2013.01); *H05B 33/0815* (2013.01); *H05B 37/0209* (2013.01)

(58) Field of Classification Search
CPC .... H05B 41/34; H05B 33/0803; H05B 39/09; H05B 41/28; H05B 33/0809; H05B 41/295; H05B 41/2827; H05B 41/3925; H05B 33/0815; H05B 33/0818; H05B 41/2828; H05B 41/3921; H05B 41/3927; H05B 37/029; H05B 37/0254; H05B 37/02; Y02B 20/202
See application file for complete search history.

(56) References Cited

U.S. PATENT DOCUMENTS 10,356,865 B2 * 7/2019 Lim ..... H05B 37/0227
2016/0134187 A1 * 5/2016 Pregitzer ..... H02M 3/156 323/285

* cited by examiner

*Primary Examiner* — Minh D A
(74) *Attorney, Agent, or Firm* — Winston Hsu

(57) ABSTRACT

An LED lighting system includes a luminescent unit driven by a rectified AC voltage and a bleeder circuit. The bleeder circuit includes a current source, a dimming detection unit and an adjusting unit. The current source is configured to provide a bleeder current according to a control signal. The dimming detection unit is configured to monitor the rectified AC voltage, thereby outputting a dimming detection signal associated with an operational mode of the LED lighting system. The adjusting unit is configured to output the control signal according to the dimming detection signal so as to instruct the current source to keep the bleeder current at a first value during a first period and at a second value smaller than the first value during a second period subsequent to the first period when the dimming detection signal indicates that the LED lighting system is operating in a dimming mode.

11 Claims, 10 Drawing Sheets

LIGHT-EMITTING DIODE LIGHTING SYSTEM WITH AUTOMATIC BLEEDER CURRENT CONTROL

CROSS REFERENCE TO RELATED APPLICATIONS

This application claims the benefit of U.S. provisional application No. 62/731,969 filed on 2018 Sep. 16.

BACKGROUND OF THE INVENTION

1. Field of the Invention

The present invention is related to an LED lighting system, and more particularly, to a dimmable LED lighting system with automatic bleeder current control.

2. Description of the Prior Art

A dimmable LED lighting system often uses a dimmer switch that employ a TRIAC (triode for alternative current) device to regulate the power delivered to an LED lamp by conducting only during a certain period of an alternative-current (AC) voltage supplied to the TRIAC. Unlike other switching elements such as BJTs or MOSFETs, the TRIAC will latch-on once it is energized (after forward current $I_F$ exceeds latching current $I_L$) and continue to conduct until the forward current $I_F$ drops below a minimum holding current $I_H$. To maintain the TRIAC in the conducting state, the minimum holding current $I_H$ needs to be supplied to the TRIAC. At turn-on, an LED load presents relatively high impedance, so input current may not be sufficient to latch the TRIAC in the dimmer switch. When the current through the TRIAC is less than the minimum holding current $I_H$, the TRIAC resets and pre-maturely turns off the dimmer switch. As a result, the LED lamp may prematurely turn off when it should be on, which may result in a perceivable light flicker or complete failure in the LED lighting system.

Therefore, a bleeder circuit is used to provide a bleeder current for voltage management and preventing the dimmer switch from turning off prematurely. However, when the dimming function of an LED lighting system is not activated, the unnecessary supply of the bleeder current costs extra power consumption.

SUMMARY OF THE INVENTION

The present invention provides an LED lighting system which includes a luminescent unit driven by a rectified AC voltage and a bleeder circuit. The bleeder circuit includes a current source, a dimming detection unit and an adjusting unit. The current source is configured to provide a bleeder current according to a control signal. The dimming detection unit is configured to monitor the rectified AC voltage, thereby outputting a dimming detection signal associated with an operational mode of the LED lighting system. The adjusting unit is configured to output the control signal according to the dimming detection signal so as to instruct the current source to keep the bleeder current at a first value during a first period and at a second value during a second period when the dimming detection signal indicates that the LED lighting system is operating in a dimming mode, wherein the first value is larger than the second value and the second period is subsequent to the first period; and adjust a sum of the bleeder current and an LED current flowing through the luminescent unit according to a duty cycle of the rectified AC voltage.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
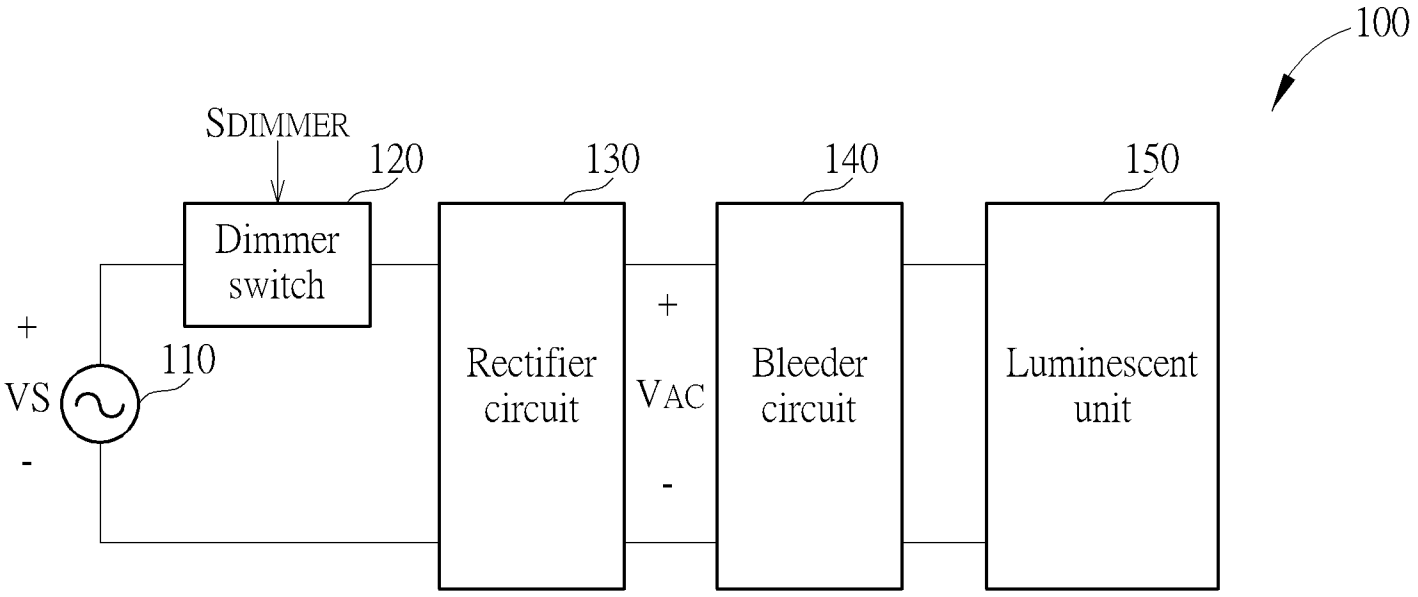
FIG. 1 is a functional diagram of a dimmable LED lighting system with automatic bleeder current control according to an embodiment of the present invention.

FIG. 1 is a functional diagram of a dimmable LED lighting system 100 with automatic bleeder current control according to an embodiment of the present invention. The LED lighting system 100 includes a power supply circuit 110, a dimmer switch 120, a rectifier circuit 130, a bleeder circuit 140, and a luminescent unit 150.

The power supply circuit 110 may be an alternative current (AC) mains which provides an AC voltage VS having positive and negative periods. The rectifier circuit 130 may include a bridge rectifier for converting the AC voltage VS into a rectified AC voltage $V_{AC}$ whose value varies periodically with time. However, the configurations of the power supply circuit 110 and the rectifier circuit 130 do not limit the scope of the present invention.

The luminescent unit 150 includes one or multiple luminescent devices and a driver. Each of the luminescent devices may adopt a single LED or multiple LEDs coupled in series. Each LED may be a single-junction LEDs, a multi-junction high-voltage (HV) LED, or another device having similar function. However, the type and configuration of the luminescent devices do not limit the scope of the present invention.

Figure 2:
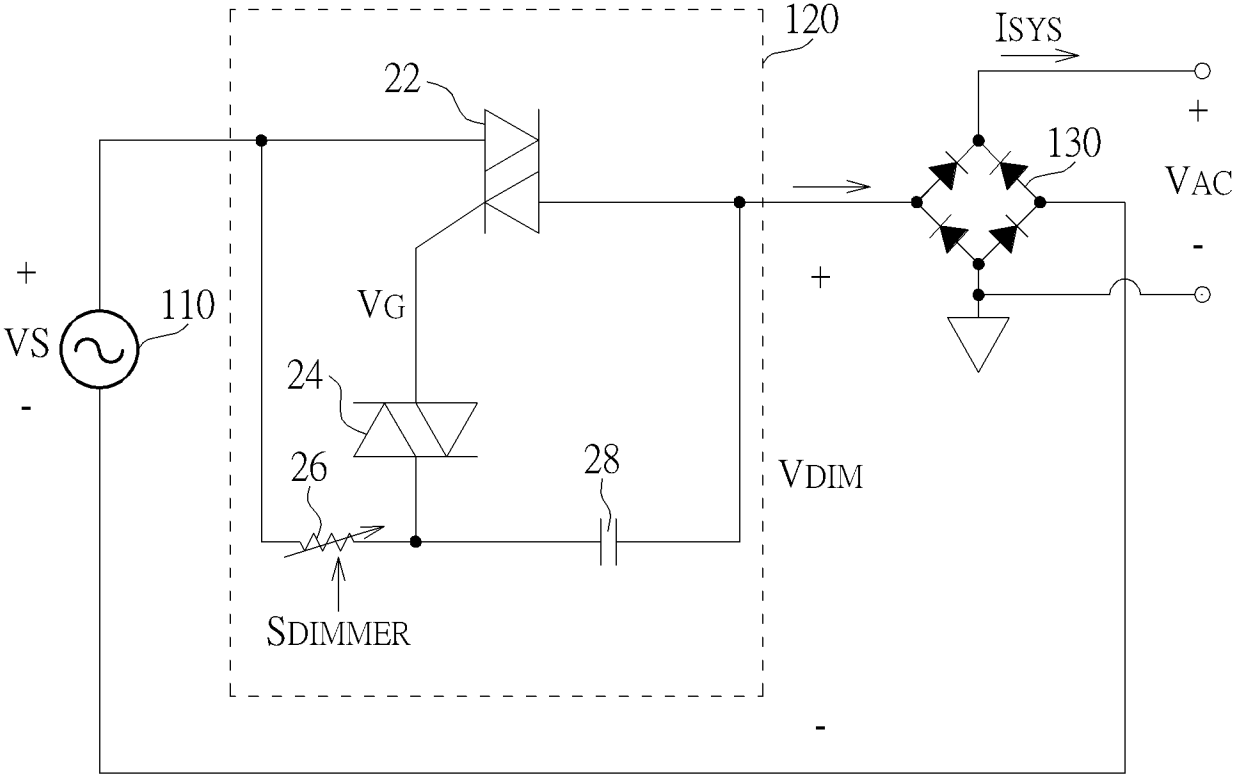
FIG. 2 is a diagram illustrating a dimmer switch in an LED lighting system with automatic bleeder current control according to an embodiment of the present invention.
Figure 3:
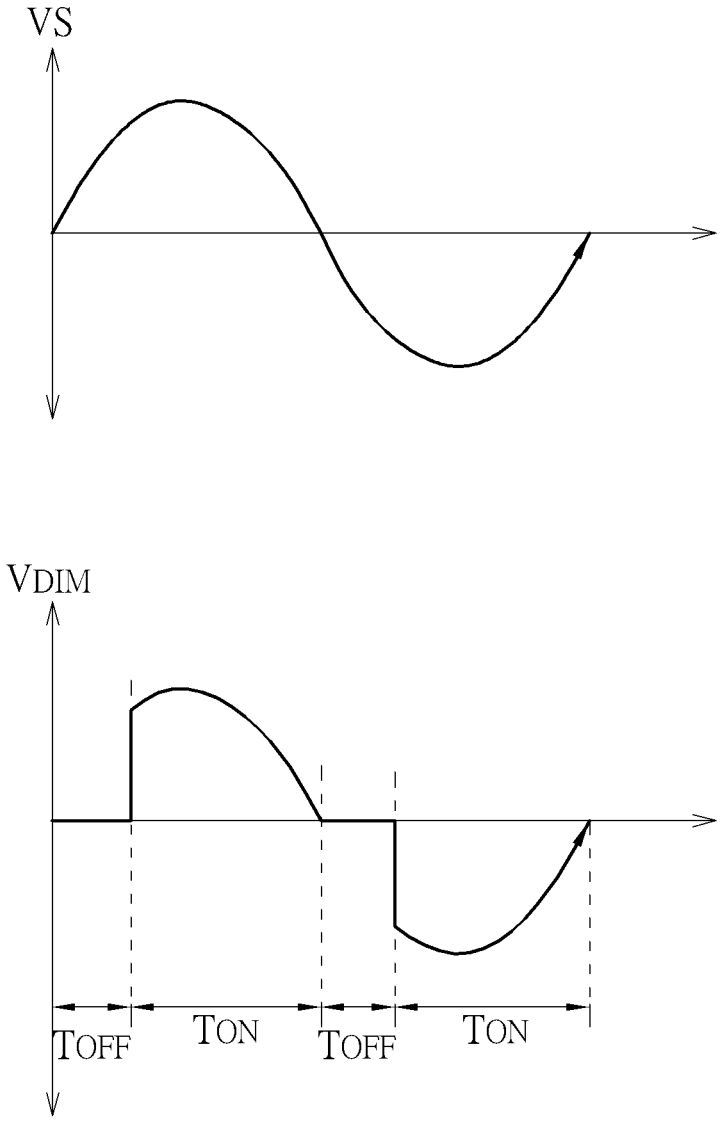
FIG. 3 is a diagram illustrating the operation of a dimmer switch in an LED lighting system with automatic bleeder current control according to an embodiment of the present invention.

FIG. 2 is a diagram illustrating the dimmer switch 120 in the LED lighting system 100 with automatic bleeder current control according to an embodiment of the present invention. FIG. 3 is a diagram illustrating the operation of the dimmer switch 120 in the LED lighting system 100 according to an embodiment of the present invention. The dimmer switch 120 is configured to control the amount (i.e., intensity) of light output by the luminescent unit 150 by phase modulating the power supply circuit 110 to adjust the duty cycle of the rectified voltage $V_{AC}$, thereby adjusting the duty cycle of the system current $I_{SYS}$ flowing through the LED lighting system 100. When the dimmer switch 120 is not in function, the voltage $V_{DIM}$ supplied to the rectifier circuit 130 is equal to the AC voltage VS provided by the power supply circuit 110; when the dimmer switch 120 is in function, the voltage $V_{DIM}$ supplied to the rectifier circuit 130 is provided by phase modulating the AC voltage VS according to a dimming input signal $S_{DIMMER}$.

In the embodiment illustrated in FIG. 2, the dimmer switch 120 is a phase-cut dimmer which includes a TRIAC device 22, a DIAC (diode for alternative current) device 24, a variable resistor 26 and a capacitor 28. The TRIAC device 22 and the DIAC device 24 are bi-directional switching elements that can conduct current in either direction when turned on (or triggered). The variable resistor 26 and the capacitor 28 provide a trigger voltage $V_G$ which has a resistor-capacitor (RC) time delay with respect to the AC voltage VS. As depicted in FIG. 3, during the turn-off periods $T_{OFF}$ of a cycle, the trigger voltage $V_G$ is insufficient to turn on the TRIAC device 22, thereby cutting off the AC voltage VS from the rectifier circuit 130 ($V_{DIM}$=0). During the turn-on periods $T_{ON}$ of a cycle when the trigger voltage $V_G$ exceeds the threshold voltage of the TRIAC device 22, the TRIAC device 22 is turned on and conducts the system current $I_{SYS}$. As long as the system current $I_{SYS}$ is kept above the minimum holding current of the TRIAC device 22, the AC voltage VS may be supplied to the rectifier circuit 130 (the waveform of $V_{DIM}$ follows the waveform of $V_{AC}$).

In the LED lighting system 100, the dimmer switch 120 determines the amount of adjustment applied to the AC voltage VS provided by the power supply circuit 110 based on the value of the dimming input signal $S_{DIMMER}$ applied to the dimmer switch 120. In some implementations, the dimming input signal $S_{DIMMER}$ is an analog signal produced by a knob, slider switch, or other suitable electrical or mechanical device capable of providing an adjustment signal with a variable range of adjustment settings. In other implementations, the dimming input signal $S_{DIMMER}$ is a digital signal. However, the implementation of the dimming input signal $S_{DIMMER}$ does not limit the scope of the present invention.

In the embodiment illustrated in FIG. 2, the value of the variable resistor 26 may be adjusted according to the dimming input signal $S_{DIMMER}$ for changing the RC time delay of the trigger voltage $V_G$ with respect to the AC voltage VS, thereby adjusting the length of the turn-off periods $T_{OFF}$ and turn-on periods $T_{ON}$ of the voltage $V_{DIM}$. Since the light output intensity of the luminescent unit 150 is substantially proportional to the rectified voltage $V_{AC}$ whose value is associated with the voltage $V_{DIM}$, the system current $I_{SYS}$ flowing through the luminescent unit 150 may be controlled in a regulated manner that provides a smooth transition in light intensity level output of the luminescent unit 150 responsive to the dimming input signal $S_{DIMMER}$ without perceivable flicker.

Figure 4:
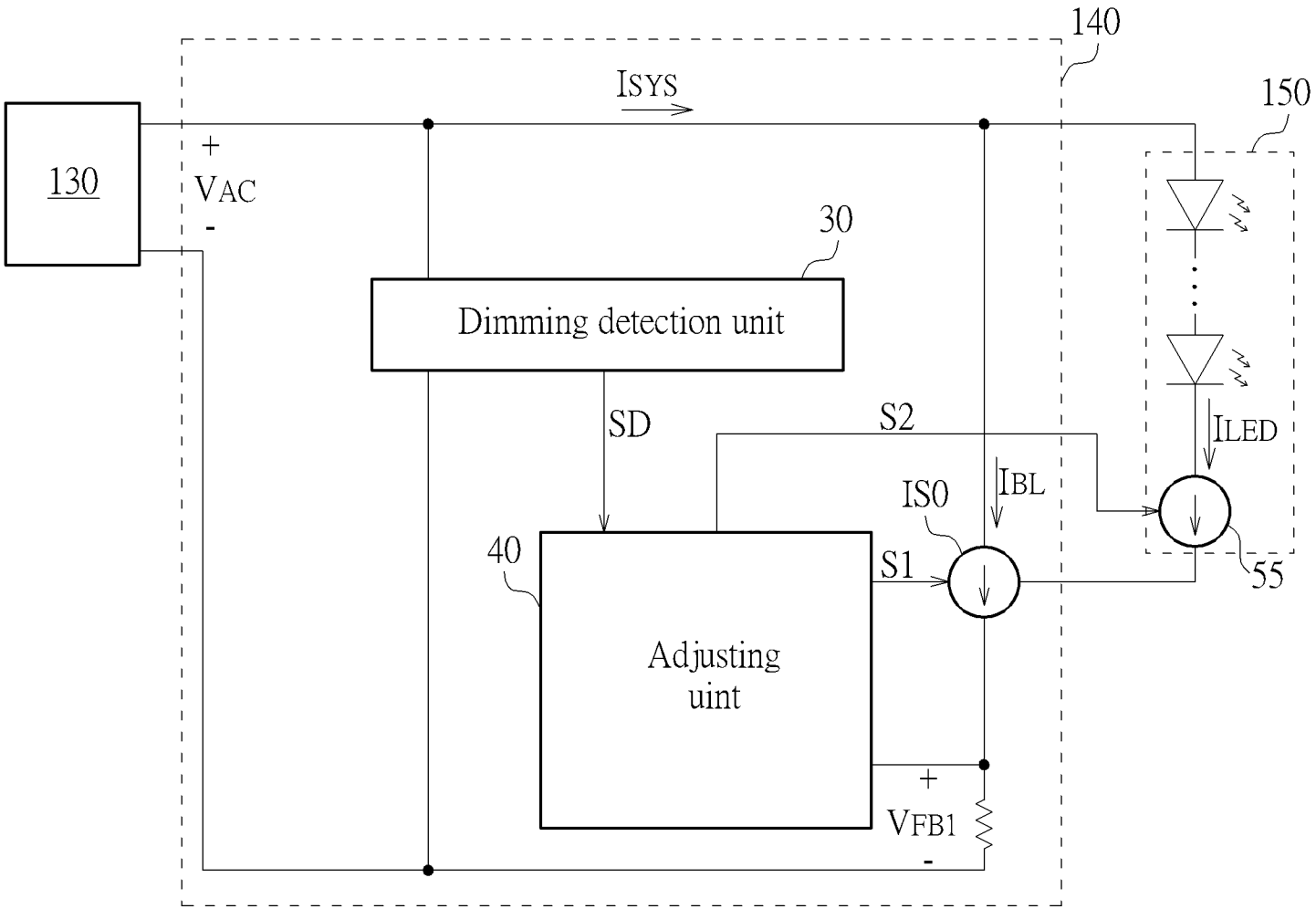
FIG. 4 is a diagram illustrating the bleeder circuit in an LED lighting system with automatic bleeder current control according to an embodiment of the present invention.

FIG. 4 is a diagram illustrating the bleeder circuit 140 in the LED lighting system 100 with automatic bleeder current control according to an embodiment of the present invention. The bleeder circuit 140 includes a current source IS0, a dimming-detection unit 30, and an adjusting unit 40. The current source IS0 is configured to operate according to a control signal S1 for providing a bleeder current $I_{BL}$ in order to sustain stable operation of the dimmer switch 120 when required. An implementation of the luminescent unit 150 is also depicted for illustrative purpose, wherein a driver 55 is configured to regulate the current $I_{LED}$ flowing through the luminescent devices according to a control signal S2. After power-on, the dimming-detection unit 30 is configured to monitor the level of the rectified voltage $V_{AC}$, thereby outputting a dimming detection signal SD associated with the operational mode of the LED lighting system 100. The adjusting unit 40 is configured to output the control signal S1 according to the dimming detection signal SD for adjusting the value of the bleeder current $I_{BL}$ provided by the current source IS0. Also, the adjusting unit 40 is configured to output the control signal S2 associated with the duty cycle of the rectified AC voltage $V_{AC}$.

Figure 5:
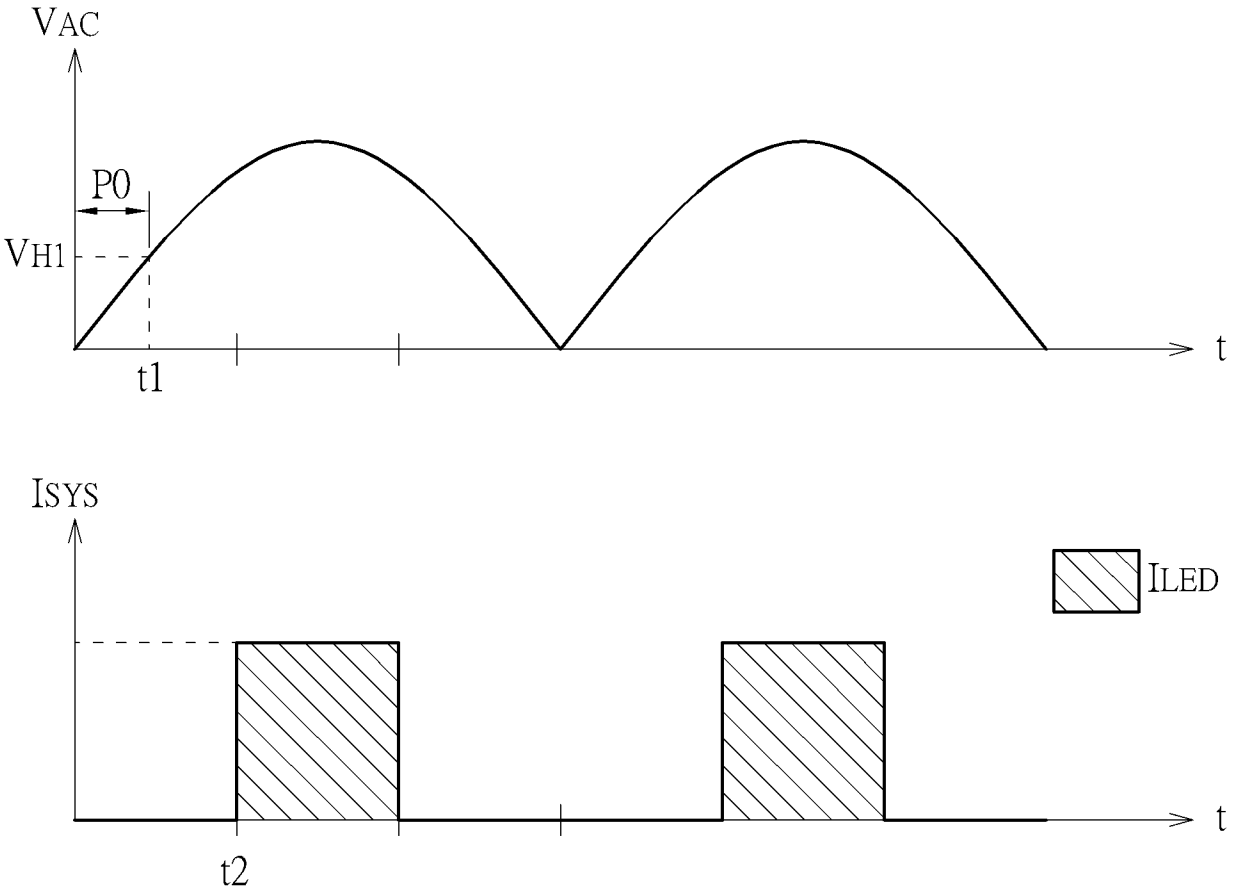
FIG. 5 is a timing diagram illustrating the operation of the bleeder circuit in an LED lighting system with automatic bleeder current control according to an embodiment of the present invention.
Figure 6:
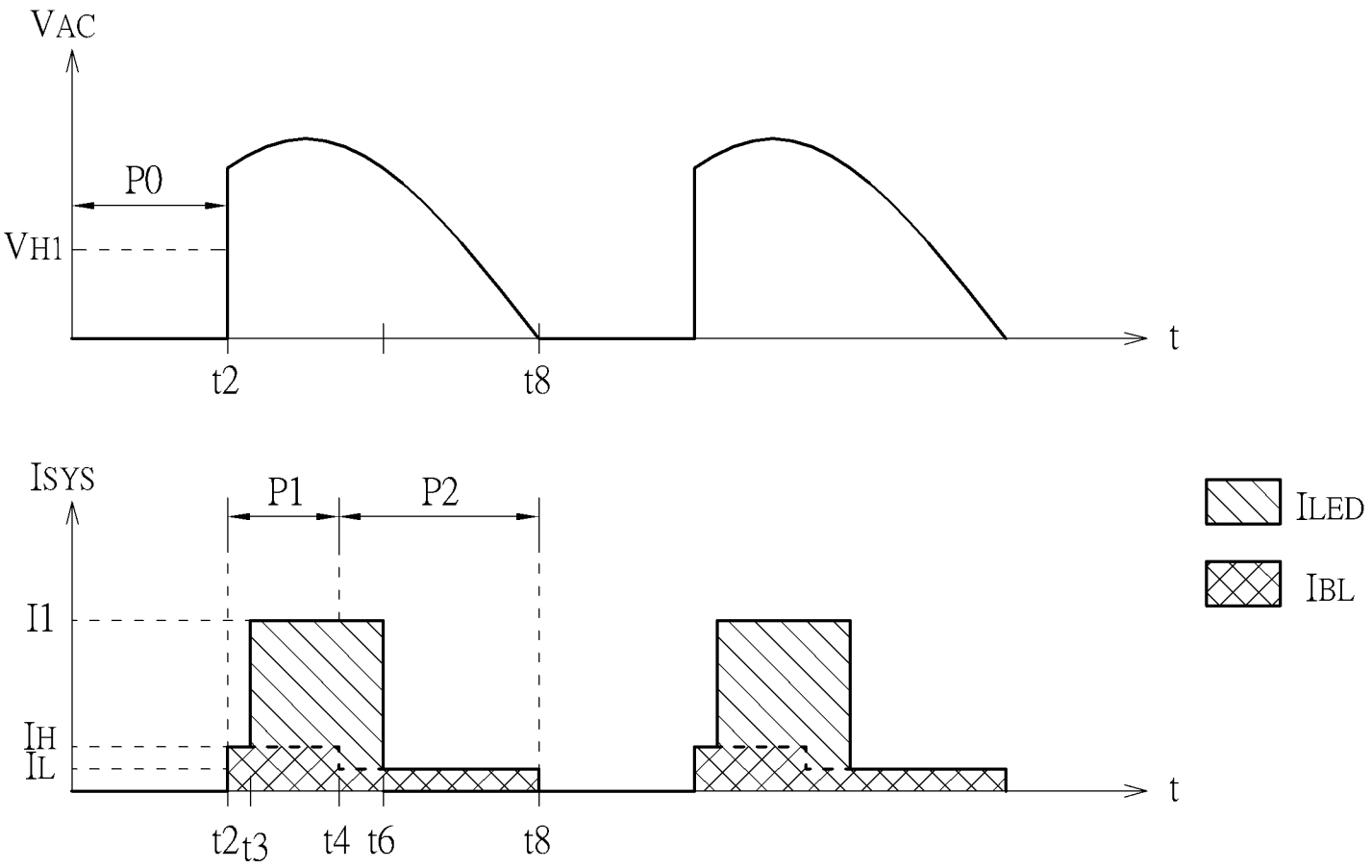
FIG. 6 is a timing diagram illustrating the operation of the bleeder circuit in an LED lighting system with automatic bleeder current control according to another embodiment of the present invention.
Figure 7:
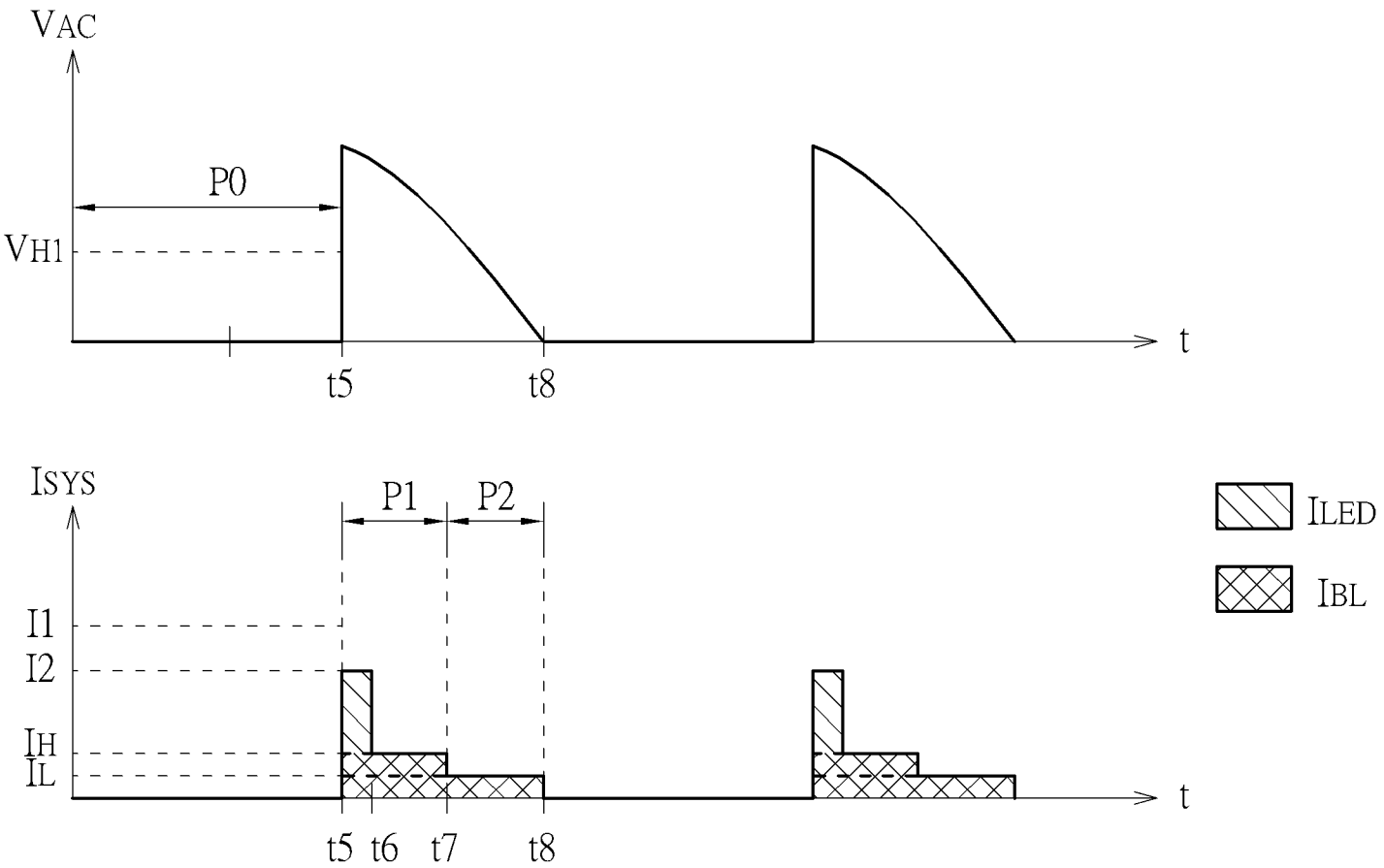
FIG. 7 is a timing diagram illustrating the operation of the bleeder circuit in an LED lighting system with automatic bleeder current control according to another embodiment of the present invention.

FIGS. 5-7 are timing diagrams illustrating the operation of the bleeder circuit 140 in the LED lighting system 100 with automatic bleeder current control according to embodiments of the present invention. In the embodiment depicted in FIG. 5, the LED lighting system 100 operates in a non-dimming mode with the dimmer switch 120 not in function. In the embodiments depicted in FIGS. 6 and 7, the LED lighting system 100 operate in a dimming mode with the dimmer switch 120 in function. For illustrative purpose, t1-t8 represent various points of time in chronological order during a cycle of the rectified AC voltage $V_{AC}$.

In an embodiment, the dimming-detection unit 30 may be configured to determine the length of time period P0 required for the rectified AC voltage $V_{AC}$ to reach or exceed a threshold voltage $V_{H1}$ from zero (the beginning of the cycle). If the time period P0 is smaller than a threshold value (indicative of a larger duty cycle) during at least m consecutive cycles of the rectified AC voltage $V_{AC}$ (m is a positive integer), it is determined that the LED lighting system 100 is currently operating in the non-dimming mode. If the time period P0 is not smaller than the threshold value (indicative of a smaller duty cycle) during at least m consecutive cycles of the rectified AC voltage $V_{AC}$, it is determined that the LED lighting system 100 is currently operating in the dimming mode.

In FIG. 5 when the dimmer switch 120 is not in function, the voltage $V_{DIM}$ supplied to the rectifier circuit 130 is equal to the AC voltage VS provided by the power supply circuit 110. That is, the rectified AC voltage $V_{AC}$ with a 100% duty cycle reaches $V_{H1}$ at t1, resulting a short time period P0 which allows the dimming-detection unit 30 to determine that the LED lighting system 100 is currently operating in the non-dimming mode. Under such circumstance, the adjusting unit 40 is configured to disable the current source IS0 for stop supplying the bleeder current $I_{DL}$.

In FIGS. 6 and 7 when the dimmer switch 120 is in function, the voltage $V_{DIM}$ supplied to the rectifier circuit 130 is provided by phase modulating the AC voltage VS according to a dimming input signal $S_{DIMMER}$. For illustrative purpose, it is assumed that in FIG. 6 the rectified AC voltage $V_{AC}$ with a duty cycle around 65% exceeds $V_{H1}$ at t2 and in FIG. 7 the rectified AC voltage $V_{AC}$ with a duty cycle around 35% exceeds $V_{H1}$ at t5. Since the rectified AC voltage $V_{AC}$ in FIG. 6 or FIG. 7 has a smaller duty cycle, it takes longer to reach or exceed $V_{H1}$, resulting a longer time period P0 which allows the dimming-detection unit 30 to determine that the LED lighting system 100 is currently operating in the dimming mode. Under such circumstance, the adjusting unit 40 is configured to enable the current source IS0 for supplying the bleeder current $I_{BL}$ in a way that the value of the bleeder current $I_{BL}$ is kept at a value $I_H$ during a period P1 and then reduced to a value $I_L$ during a period P2 subsequent to the period P1, wherein $I_L<I_H$. Meanwhile, the adjusting unit 40 may adjust the sum of the current $I_{BL}$ and $I_{LED}$ according to a feedback voltage $V_{FB1}$ established at the output node of the current source IS0 and the duty cycle of the rectified AC voltage $V_{AC}$.

In the embodiment depicted in FIG. 6 when the dimming input signal $S_{DIMMER}$ indicates a medium-brightness dimming in which the rectified AC voltage $V_{AC}$ is phase modulated to have a reduced duty cycle around 65%, the period between t3 and t6 during which the luminescent unit 150 is conducting ($I_{LED}>0$) may be longer than the period P1 (between t2 and t4). Therefore, the adjusting unit 40 may instruct the current source IS0 to supply the bleeder current $I_{BL}$ having the value $I_H$ during the period P1 (between t2 and t4) and supply the bleeder current $I_{BL}$ having the value $I_L$ during the period P2 (between t4 and t8), wherein $I_L<I_H$. This way, stable operation of the dimmer switch 120 may be sustained by the bleeder current $I_{BL}$ having the value $I_H$ between t2 and t3, by both the bleeder current $I_{BL}$ and the current $I_{LED}$ between t3 and t6, and then by the bleeder current $I_{BL}$ having the value $I_L$ between t6 and t8.

In the present invention, the bleeder current $I_{BL}$ is kept at $I_H$ during the period P1 and then reduced to $I_L$ during the period P2 when the LED lighting system 100 is currently operating in the dimming mode. In an embodiment, the adjusting unit 40 may instruct the current source IS0 to stop supplying the bleeder current $I_{BL}$ during the period P2 after supplying the bleeder current $I_{BL}$ having the value $I_H$ during the period P1 ($I_L=0$).

In the embodiment in FIG. 7 when the dimming input signal $S_{DIMMER}$ indicates a low-brightness dimming in which the rectified AC voltage $V_{AC}$ is phase modulated to have a reduced duty cycle around 35%, the period between t5 and t6 during which the luminescent unit 150 is conducting ($I_{LED}>0$) may be very short. Therefore, the adjusting unit 40 may instruct the current source IS0 to supply the bleeder current $I_{BL}$ having the first value $I_H$ during the period P1 (between t5 and t7) and supply the bleeder current $I_{BL}$ having the value $I_L$ during the period P2 (between t7 and t8). This way, stable operation of the dimmer switch 120 may be sustained by both the bleeder current $I_{BL}$ and the current $I_{LED}$ between t5 and t6, by the bleeder current $I_{BL}$ having the value $I_H$ between t6 and t7, and then by the bleeder current $I_{BL}$ having the value $I_L$ between t7 and t8.

As previously stated, the adjusting unit 40 may regulate the system current $I_{SYS}$ by outputting the control signal S2 associated with the duty cycle of the rectified AC voltage $V_{AC}$, thereby instructing the driver 55 to regulate the LED current $I_{LED}$ accordingly. In the embodiment depicted in FIG. 6 when the rectified AC voltage $V_{AC}$ is phase modulated to have a reduced duty cycle around 65%, the driver 55 is configured to keep the LED current $I_{LED}$ at its current value so that the maximum of the system current $I_{SYS}$ may be clamped at a value I1. In the embodiment depicted in FIG. 7 when the rectified AC voltage $V_{AC}$ is phase modulated to have a reduced duty cycle around 35%, the driver 55 is configured to reduce the LED current $I_{LED}$ so that the maximum of the system current $I_{SYS}$ may be clamped at a value I2 smaller than I1. By decreasing the system current $I_{SYS}$ during low-brightness dimming, the flicker may be made less perceivable to human eyes.

Figure 8:
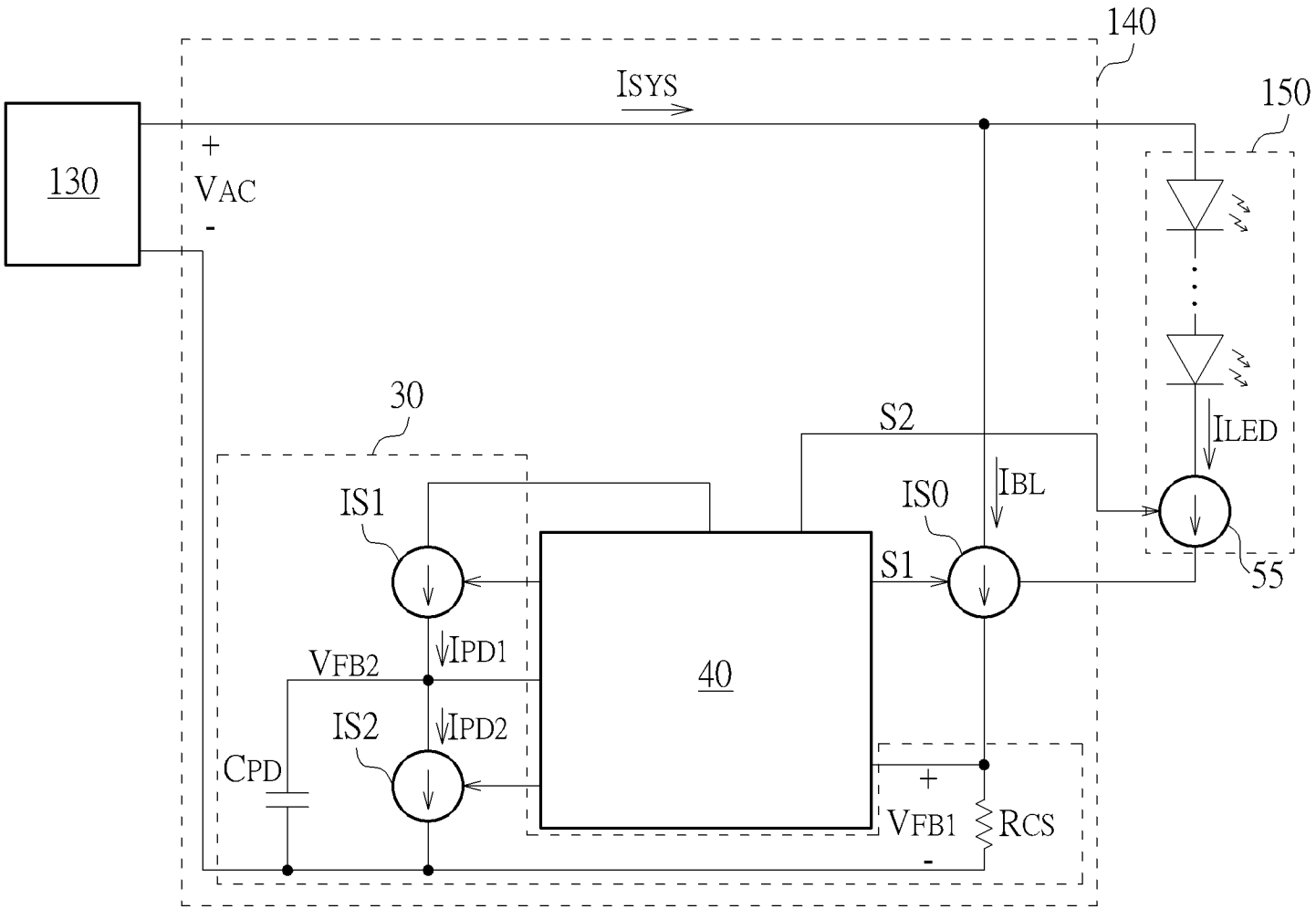
FIG. 8 is a diagram illustrating an implementation of the dimming-detection unit in an LED lighting system with automatic bleeder current control according to another embodiment of the present invention.

FIG. 8 is a diagram illustrating an implementation of the dimming-detection unit 30 according to another embodiment of the present invention. The dimming-detection unit 30 includes two current sources IS1-IS2, a current-sensing element $R_{CS}$, and a capacitor $C_{ED}$. After power-on, the level of the rectified voltage $V_{AC}$ may be monitored according to the feedback voltage $V_{FB1}$ established across the current-sensing element $R_{CS}$. In an embodiment, the current-sensing element $R_{CS}$ may be a resistor, but the implementation of the current-sensing element $R_{CS}$ does not limit the scope of the present invention.

When the feedback voltage $V_{FB1}$ indicates that the rectified AC voltage $V_{AC}$ has reached or exceeded a predetermined value, the dimming-detection unit 30 is configured to activate the current source IS1 and disable the current source IS2 for charging the capacitor $C_{PD}$. When the feedback voltage $V_{FB1}$ indicates that the rectified AC voltage $V_{AC}$ has not reached or exceeded the predetermined value, the dimming-detection unit 30 is configured to disable the current source IS1 and activate the current source IS2 for discharging the capacitor $C_{PD}$.

Figure 9:
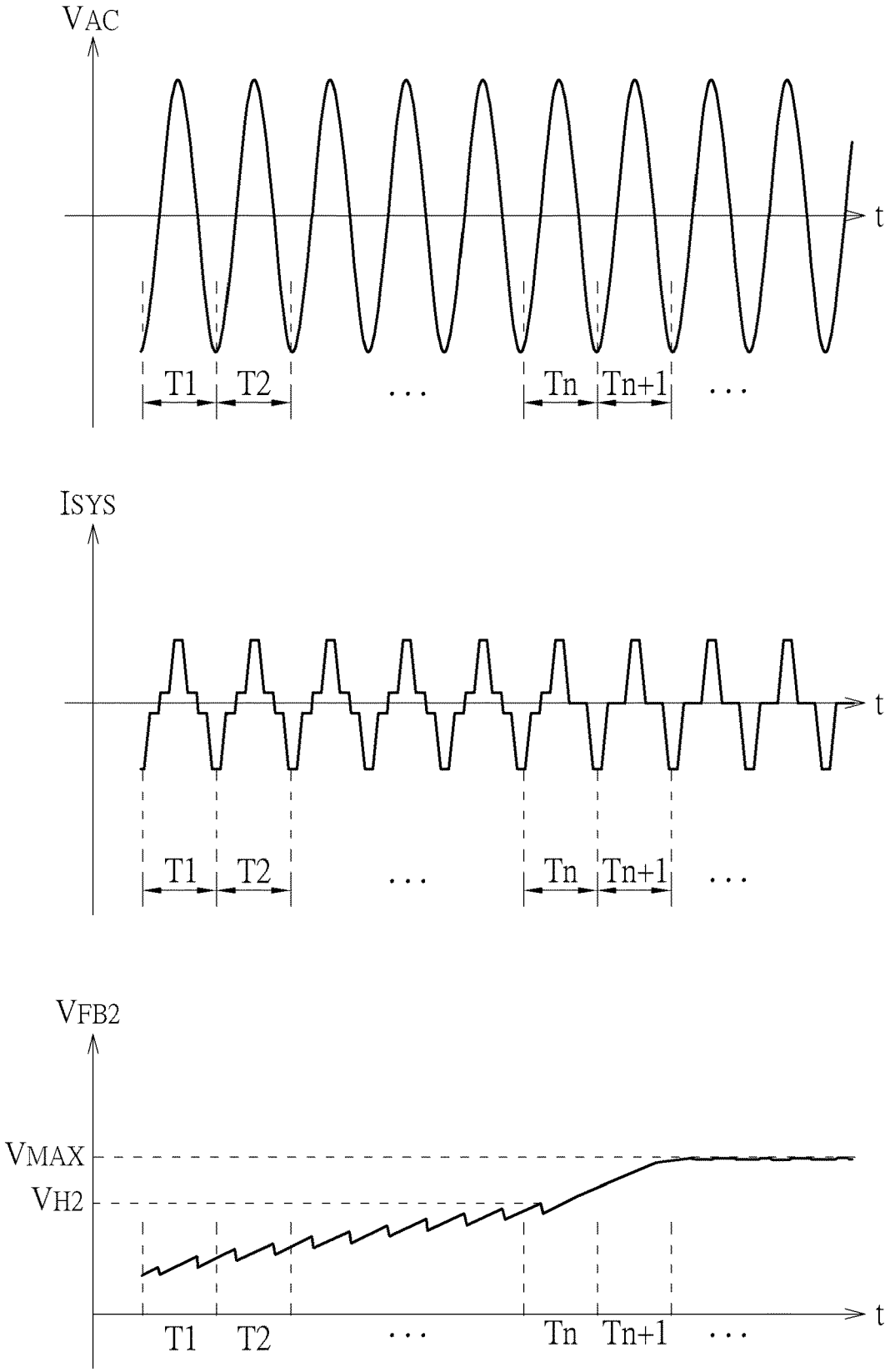
FIG. 9 is a diagram illustrating the current/voltage characteristics of an LED lighting system with automatic bleeder current control according to an embodiment of the present invention.
Figure 10:
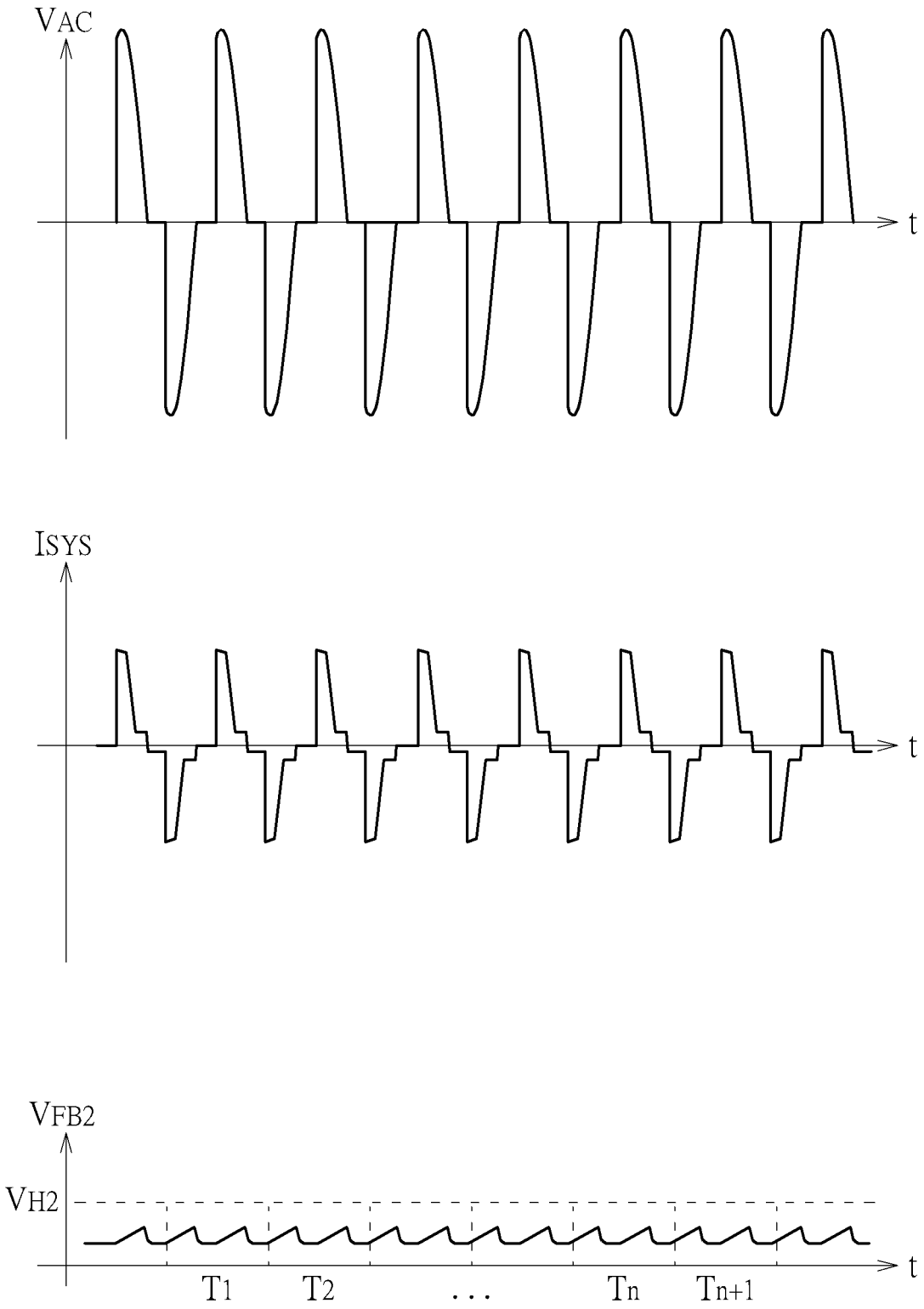
FIG. 10 is a diagram illustrating the current/voltage characteristics of an LED lighting system with automatic bleeder current control according to another embodiment of the present invention.

FIGS. 9 and 10 are diagrams illustrating the current/voltage characteristics of the LED lighting system 100 with automatic bleeder current control according to an embodiment of the present invention. FIG. 9 depicts the waveforms of the rectified AC voltage $V_{AC}$, the system current $I_{SYS}$ and feedback voltage $V_{FB2}$ during multiple cycles of the rectified AC voltage $V_{AC}$ when the dimmer switch 120 is not in function. FIG. 10 depicts the waveforms of the rectified AC voltage $V_{AC}$, the system current $I_{SYS}$ and feedback voltage $V_{FB2}$ during multiple cycles of the rectified AC voltage $V_{AC}$ when the dimmer switch 120 is in function.

In FIG. 9, it is assumed that the duty cycle of the system current $I_{SYS}$ is larger than 95%. The feedback voltage $V_{FB2}$ established across the capacitor $C_{PD}$ has a zigzag waveform during the first n cycles T1-Tn of the rectified AC voltage $V_{AC}$, wherein the rising segments represent the charging period of the capacitor $C_{PD}$ and the falling segments represent the discharging period of the capacitor $C_{PD}$. By setting the value of the current sources IS1 and IS2 to allow the charging energy of the capacitor $C_{PD}$ to be larger than the discharging energy of the capacitor $C_{PD}$, the feedback voltage $V_{FB2}$ established across the capacitor $C_{ET}$ gradually increases, as depicted in FIG. 9. When the feedback voltage $V_{FB2}$ reaches a threshold voltage $V_{H2}$ during the cycle Tn, the dimming-detection unit 30 may determine that the LED lighting system 100 is currently operating in the non-dimming mode. Therefore, the adjusting unit 40 may clamp the feedback voltage $V_{FB2}$ at an upper limit voltage $V_{MAX}$ larger than $V_{H2}$ and disable the current source IS0 for stop supplying the bleeder current $I_{BL}$ when the dimming function is not required, thereby reducing the power consumption of the LED lighting system 100.

In FIG. 10, it is assumed that the duty cycle of the system current $I_{SYS}$ is smaller than 90%. The feedback voltage $V_{FB2}$ has a zigzag waveform, wherein the rising segments represent the charging period of the capacitor $C_{ET}$ and the falling segments represent the discharging period of the capacitor $C_{PD}$. By setting the value of the current sources IS1 and IS2 to allow the charging energy to be lower than or equal to the discharging energy of the capacitor $C_{ET}$, the feedback voltage $V_{FB2}$ established across the capacitor $C_{ET}$ remains at a level substantially lower than the threshold voltage $V_{H2}$, as depicted in FIG. 10. With the feedback voltage $V_{FB2}$ remaining smaller than the threshold voltage $V_{H2}$, the dimming-detection unit 30 may determine that the LED lighting system 100 is currently operating in the dimming mode. Therefore, the adjusting unit 40 may instruct the current source IS0 to supply the bleeder current $I_{BL}$ having the value $I_H$ during the period P1 and supply the bleeder current $I_{BL}$ having the value $I_L$ during the period P2, as depicted in FIGS. 6 and 7. This way, the system current $I_{SYS}$ may be kept above the minimum holding current of the TRIAC device 22, thereby allowing proper operation of the dimmer switch 120 in the LED lighting system 100.

In conclusion, the present invention can determine whether the supply of the bleeder current $I_{BL}$ for dimmer function is required by monitoring the rectified voltage $V_{AC}$. The system current $I_{SYS}$ may be kept above the minimum holding current of the TRIAC device 22 for ensuring proper operation of the dimmer switch 120 by keeping the bleeder current $I_{BL}$ at a first value during a first period and then at a second value during a second period. Also, the system current $I_{SYS}$ is reduced in response to low-brightness dimming, thereby making flicker less perceivable to human eyes.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A light-emitting diode (LED) lighting system, comprising:

a luminescent unit driven by a rectified alternative-current (AC) voltage; and a bleeder circuit comprising:

a first current source configured to provide a bleeder current according to a first control signal;

a dimming detection unit configured to monitor the rectified AC voltage, thereby outputting a dimming detection signal associated with an operational mode of the LED lighting system; and an adjusting unit configured to:

output the first control signal according to the dimming detection signal so as to instruct the first current source to keep the bleeder current at a first value during a first period and at a second value during a second period when the dimming detection signal indicates that the LED lighting system is operating in a dimming mode, wherein the first value is larger than the second value and the second period is subsequent to the first period; and adjust a sum of the bleeder current and an LED current flowing through the luminescent unit according to a duty cycle of the rectified AC voltage.

2. The LED lighting system of claim 1, wherein:

the adjusting unit is further configured to clamp the sum of the bleeder current and the LED current at a third value when the rectified AC voltage has a first duty cycle, or clamp the sum of the bleeder current and the LED current at a fourth value when the rectified AC voltage has a second duty cycle;

the third value is larger than the fourth value; and the first duty cycle is larger than the second duty cycle.

3. The LED lighting system of claim 1, wherein:

the first current source comprises:

a first end coupled to the rectified AC voltage;

a second end; and a control end coupled to the first control signal; and the adjusting unit is configured to adjust the sum of the bleeder current and the LED current according to a first feedback voltage established at the second end of the first current source and the duty cycle of the rectified AC voltage.

4. The LED lighting system of claim 3, further comprising a driver coupled in series to the luminescent unit and configured to regulate the LED current according to a second control signal, wherein:

the adjusting unit is further configured to output the second control signal so as to instruct the driver to adjust the LED current to a third value when the rectified AC voltage has a first duty cycle, or adjust the LED current to a fourth value when the rectified AC voltage has a second duty cycle;

the third value is larger than the fourth value; and the first duty cycle is larger than the second duty cycle.

5. The LED lighting system of claim 1, wherein the dimming detection unit comprises:

a second current source configured to provide a charging current;

a third current source coupled in series to the second current source and configured to provide a discharging current;

a current-sensing element for providing a first feedback voltage associated with a level of the rectified AC voltage; and a capacitor having an end coupled between the second current source and the third current source for providing a second feedback voltage.

6. The LED lighting system of claim 5, wherein the dimming detection unit is further configured to:

activate the second current source and deactivate the third current source for charging the capacitor when the first feedback voltage exceeds a threshold voltage; and deactivate the second current source and activate the third current source for discharging the capacitor when the first feedback voltage does not exceed the threshold voltage.

7. The LED lighting system of claim 5, wherein the dimming detection unit is further configured to:

output the dimming detection signal which indicates that the LED lighting system is operating in a non-dimming mode when the second feedback voltage is equal to or larger than a threshold voltage; or output the dimming detection signal which indicates that the LED lighting system is operating in a dimming mode when the second feedback voltage is smaller than the threshold voltage.

8. The LED lighting system of claim 1, wherein the dimming detection unit is further configured to:

determine a length of a third period required for the rectified AC voltage to reach or exceed a threshold voltage from zero;

output the dimming detection signal which indicates that the LED lighting system is operating in a non-dimming mode when the length of third period is smaller than a fifth value; or output the dimming detection signal which indicates that the LED lighting system is operating in a dimming mode when the length of third period is not smaller than the fifth value.

9. The LED lighting system of claim 1, wherein the dimming detection unit is further configured to:

determine a length of a third period required for the rectified AC voltage to reach or exceed a threshold voltage from zero;

output the dimming detection signal which indicates that the LED lighting system is operating in a non-dimming mode when the length of third period is smaller than a fifth value during a plurality of consecutive cycles of the rectified AC voltage; or output the dimming detection signal which indicates that the LED lighting system is operating in a dimming mode when the length of third period is not smaller than the fifth value during the plurality of consecutive cycles of the rectified AC voltage.

10. The LED lighting system of claim 1, further comprising a dimmer switch configured to control an amount of light output by the luminescent unit by adjusting the duty cycle of the rectified voltage.

11. The LED lighting system of claim 10, wherein the dimmer switch comprises a TRIAC (triode for alternative current) device configured to phase modulate the rectified AC voltage, thereby adjusting the duty cycle of the rectified voltage.

* * * * *